US009668599B1

(12) United States Patent
Ellsworth et al.

(10) Patent No.: US 9,668,599 B1
(45) Date of Patent: Jun. 6, 2017

(54) DRINKING CONTAINER WITH SPINNER MECHANISM

(71) Applicant: Ingeniri, LLC, Long Beach, CA (US)

(72) Inventors: Sky Ellsworth, Long Beach, CA (US); Daniel Massie, Mission Viejo, CA (US); Claire Massie, Mission Viejo, CA (US); Satish Yalamanchili, Irvine, CA (US)

(73) Assignee: Ingeniri, LLC, Long Beach, CA (US)

( * ) Notice: Subject to any disclaimer, the term of this patent is extended or adjusted under 35 U.S.C. 154(b) by 240 days.

(21) Appl. No.: 14/497,300

(22) Filed: Sep. 25, 2014

Related U.S. Application Data

(60) Provisional application No. 61/960,706, filed on Sep. 25, 2013.

(51) Int. Cl.

| | |
|---|---|
| ***A47G 19/22*** | (2006.01) |
| ***A47G 21/18*** | (2006.01) |
| ***B65D 47/32*** | (2006.01) |
| ***B65D 51/24*** | (2006.01) |
| ***A63H 33/40*** | (2006.01) |

(52) U.S. Cl.
CPC ..... *A47G 21/182* (2013.01); *A47G 19/2222* (2013.01); *A47G 19/2227* (2013.01); *A63H 33/40* (2013.01); *B65D 51/24* (2013.01)

(58) Field of Classification Search
CPC ..... B65D 51/24; A47G 19/2227; A63H 33/40
USPC ..... 220/703, 705, 707; 446/74, 200, 199, 446/201, 202, 217, 218
See application file for complete search history.

(56) References Cited

U.S. PATENT DOCUMENTS

| | | | | |
|---|---|---|---|---|
| 2,544,594 | A | 3/1951 | Goldfarb | |
| 3,782,028 | A * | 1/1974 | Kelly | A63H 29/14 446/200 |
| 3,834,068 | A * | 9/1974 | Fabricant | A63H 33/00 446/200 |
| 5,393,258 | A * | 2/1995 | Karterman | B65D 51/248 446/200 |
| 6,502,714 | B1 * | 1/2003 | Lei | A47G 21/182 220/501 |
| 6,579,141 | B2 * | 6/2003 | Bayliss | A47G 19/2227 220/707 |
| D555,410 | S | 11/2007 | Sheedy | |
| 7,309,136 | B2 | 12/2007 | Lei | |
| 7,402,092 | B1 | 7/2008 | Randall et al. | |
| 2013/0231026 | A1 * | 9/2013 | Keungmanivong | A47G 21/182 446/200 |

* cited by examiner

*Primary Examiner* — Andrew Perreault
(74) *Attorney, Agent, or Firm* — Eric Karich; Karich & Associate

(57) ABSTRACT

A drinking container has a spinner mechanism that includes a spinner housing for providing a spinner chamber. A spinner disk fits securely within the spinner chamber when rotatably mounted therein. The spinner mechanism includes a fluid input through the chamber perimeter surface, and a fluid outlet for allowing the liquid out of the spinner chamber once it has contacted the spinner disk. A jet nozzle directs a liquid from the fluid input across top and bottom surfaces of the spinner disk. The spinner disk does not include paddles, but relies primarily on viscous and adhesive forces to transfer energy from the flowing liquid to the surface of the spinner disk.

12 Claims, 5 Drawing Sheets

DRINKING CONTAINER WITH SPINNER MECHANISM

CROSS-REFERENCE TO RELATED APPLICATIONS

This application for a utility patent claims the benefit of U.S. Provisional Application No. 61/960,706, filed Sep. 25, 2013, which is hereby incorporated by reference in full.

BACKGROUND OF THE INVENTION

Field of the Invention

This invention relates generally to drinking containers, and more particularly to a drinking cup that includes a spinner mechanism for the amusement of a person drinking from the drinking container.

Description of Related Art

People, especially children, desire new and interesting ways to enhance routine tasks such as drinking. Children sometimes need incentive to consume healthier liquids. Retailers need new ways to entice buyers and promote brands.

People, and children in particular, enjoy interactive, dynamic devices that move. Prior drinking devices have been developed for enhanced entertainment, but they have achieved limited success in combining both low cost and maintenance with high usability, safety, and entertainment value.

The prior art teaches various children's cups that include spinners for the enjoyment of the child drinking from the cup.

Goldfarb, U.S. Pat. No. 2,544,594, for example, teaches a spinner housed in a cup lid. The spinner includes a top surface with decorated figures and the like, and a bottom surface with a plurality of vanes that extend downwardly from the spinner. A liquid input sprays a liquid from the cup upwardly against the vanes of the spinner, causing the spinner to rotate. The problem with this construction is that there is a large space formed between the spinner and the bottom portion of the lid (partially for accommodating the vanes and decorated figures), and a sump to gather the drinking liquid. This space contains air that can introduce air pockets, bubbles, and/or foam, and interfere with drinking from the cup. Furthermore, the sump may empty faster than it can be filled, or the sump liquid can be displaced when the cup is tilted, interfering with drinking.

The prior art teaches lidded cups with spinners that include vanes. However, the prior art does not teach a drinking container that includes a spinner mechanism that does not include vanes, blades, paddles, or similar structures. The present invention fulfills these needs and provides further advantages as described in the following summary.

SUMMARY OF THE INVENTION

The present invention teaches certain benefits in construction and use which give rise to the objectives described below.

The present invention provides a drinking container with a spinner mechanism that includes a spinner housing for providing a spinner chamber. A spinner disk fits securely within the spinner chamber when rotatably mounted therein. The spinner mechanism includes a liquid input through a chamber perimeter surface, and a liquid outlet for allowing the liquid out of the spinner chamber once it has contacted the spinner disk. A jet nozzle directs a liquid jet from the liquid input across top and bottom surfaces of the spinner disk, following a generally circular path around the disk axis. The spinner disk does not include paddles, but relies primarily on viscous and adhesive forces to transfer energy from the flowing liquid to the surface of the spinner disk.

A primary objective of the present invention is to provide a container that includes a spinner mechanism having advantages not taught by the prior art.

Another objective is to provide a spinner mechanism that includes a jet nozzle that directs a jet of liquid from the liquid input across the top and bottom surface of the spinner disk, following a generally circular path around the disk axis, such that the spinner disk does not require paddles, but relies primarily on viscous and adhesive forces to transfer energy from the flowing liquid to the top and bottom surfaces of the spinner disk.

Another objective is to provide a spinner mechanism that provides visual stimulation of a spinning disk to a child whenever he or she drinks from the drinking container.

A further objective is to provide a spinner mechanism that is easy to disassemble and clean.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a drinking container 10 that includes a spinner mechanism 60 for providing an entertaining display for children drinking from the drinking container 10.

Figure 1:
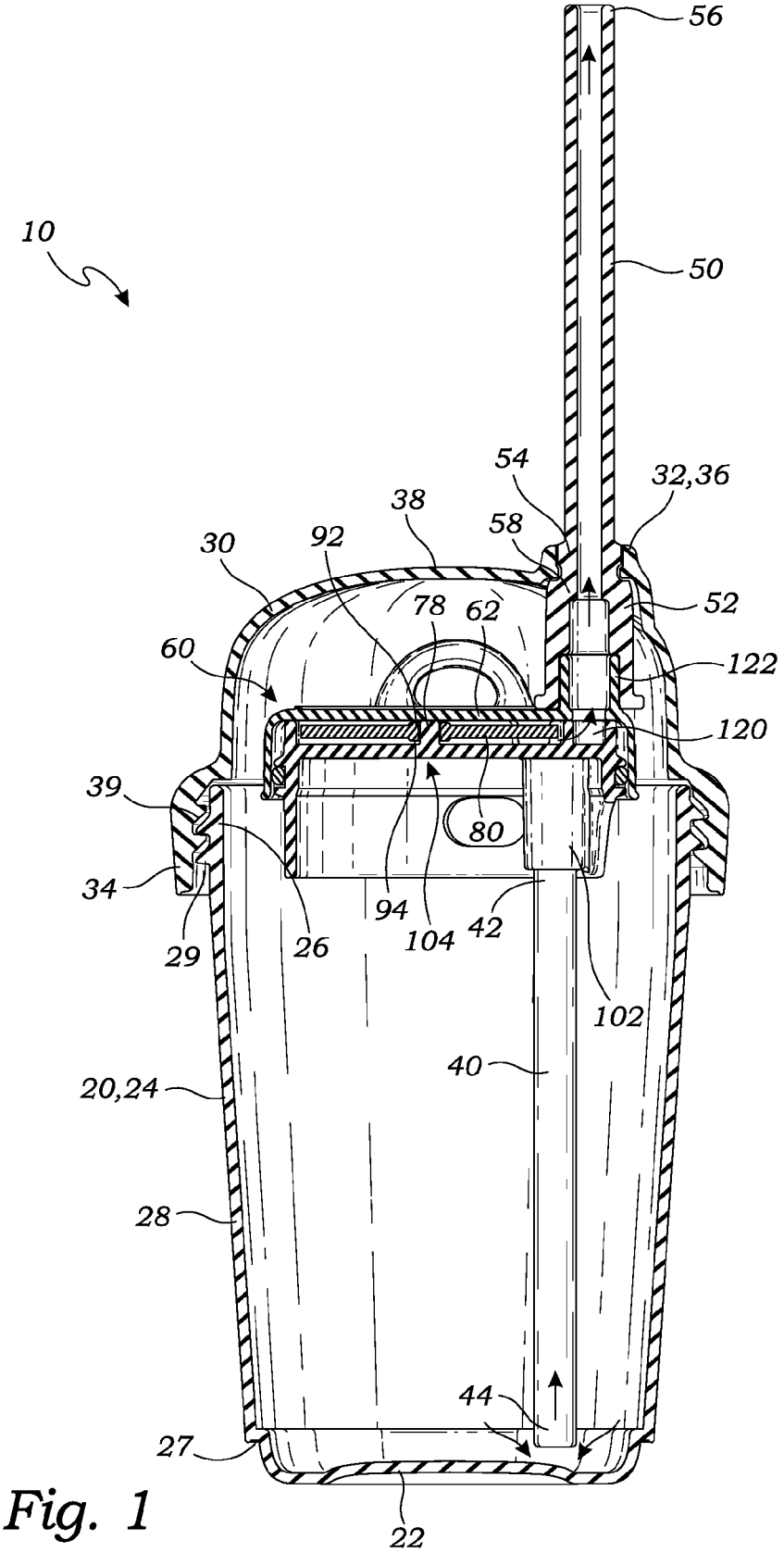
FIG. 1 is a side sectional view of a drinking container according to one embodiment of the present invention.
Figure 2:
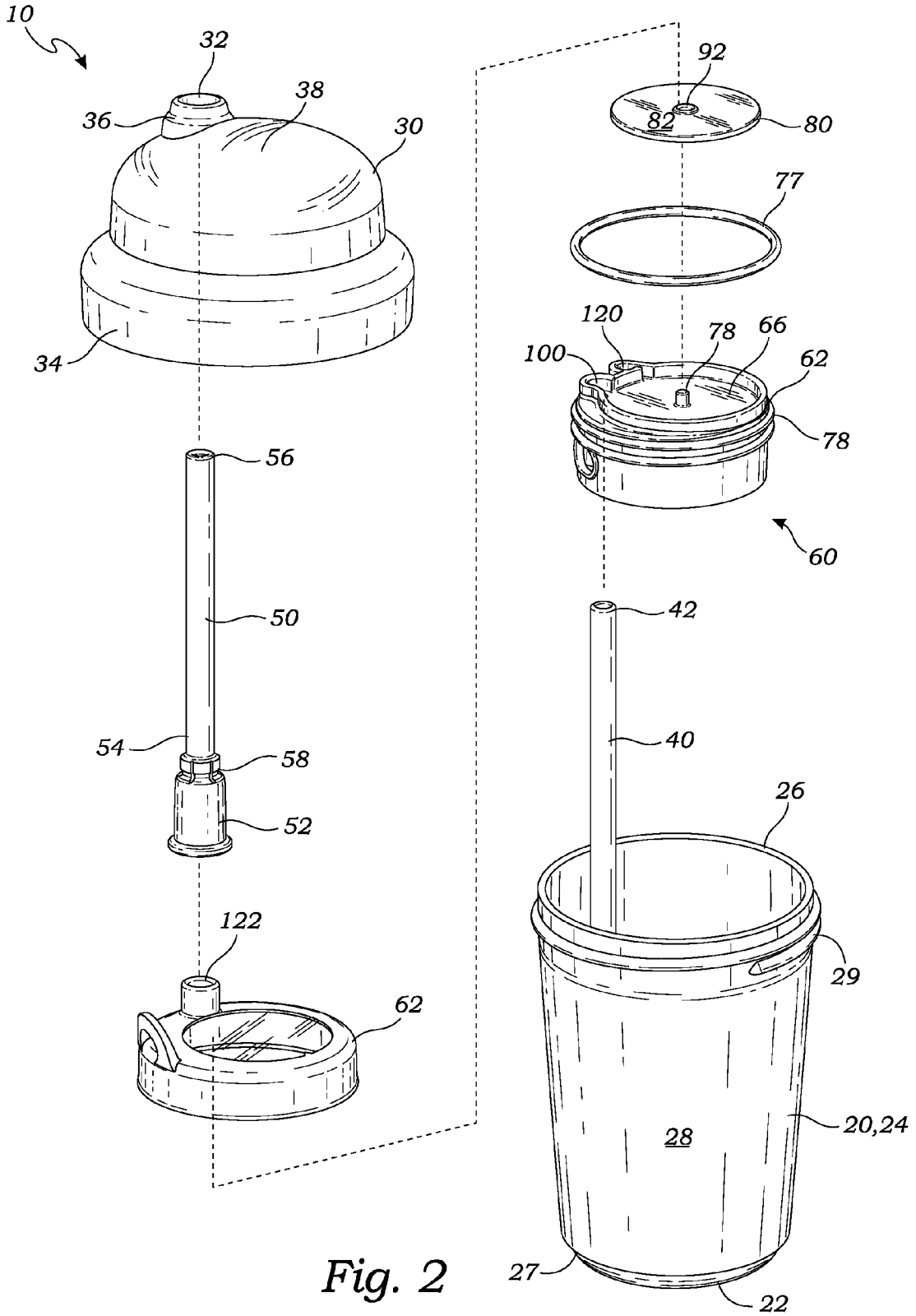
FIG. 2 is an exploded perspective view thereof.

FIG. 1 is a side sectional view of a drinking container 10 according to one embodiment of the present invention. FIG. 2 is an exploded perspective view thereof. As shown in FIGS. 1 and 2, the drinking container 10 includes a cup base 20, a cup lid 30, and the spinner mechanism 60, and may be further connected to a top straw 50 and a bottom straw 40. The cup base 20 and the cup lid 30 are connected for holding a liquid (not shown), and the spinner mechanism 60 is mounted in the cup base 20 for providing the display.

In the embodiment of FIGS. 1 and 2, the cup base 20 has a cup bottom 22 and a cup wall 24 that extends upwardly to a top perimeter 26. In the present embodiment, the cup base 20 includes an outward step 27, and a conical body portion 28 of the cup wall 24 that extends upwardly above the outward step 27. The top perimeter 26 may include threading 29, or an equivalent structure, for engaging the cup lid 30. While one embodiment of the drinking container 10 may have any form, shape, or additional features, including any cups that are known in the art, and such alternatives should be considered within the scope of the present invention.

In this embodiment, the cup lid 30 includes a straw aperture 32 through the cup lid 30, and a lid perimeter 34 that engages the top perimeter 26 of the cup base 20. The straw aperture 32 may include an upwardly extending flange 36, as shown, or may be an alternative construction that functions as described herein. A top surface 38 of the cup lid 30 may be generally flat, and may be transparent, to facilitate viewing of the spinner mechanism 60.

The lid perimeter 34 of the cup lid 30 may include another threading 39, or an equivalent structure, for engaging the cup base 20, as mentioned above. The cup lid 30 preferably forms an airtight seal with the cup base 20, to prevent leakage if the drinking container 10 is tipped over; however, this is not required in alternative embodiments. Since the general construction of such cups is well known in the art, these aspects of the invention are not described in greater detail herein.

The spinner mechanism 60 is adapted to spin when a person is drinking from the drinking container 10. The spinner mechanism 60 includes a liquid input 100 and a liquid outlet 120 for receiving the liquid into the spinner mechanism 60, and then allowing the liquid out of the spinner mechanism 60. The construction of the spinner mechanism 60 is shown in greater detail in the following drawing figures, and is discussed in greater detail below.

As shown in FIGS. 1 and 2, the liquid input 100 may receive the liquid from the bottom straw 40, and the liquid outlet 120 may direct the liquid into the top straw 50, for directing the liquid into and out of the spinner mechanism 60. However, this is not required, and in alternative embodiments or arrangements these straws may be omitted or used in different configurations.

In the present embodiment, the bottom straw 40 includes a top end 42 and a bottom end 44, the top end 42 being engaged with the liquid input 100 of the spinner mechanism 60. In this embodiment, the top end 42 of the bottom straw 40 is operably engaged with the liquid input 100 of the spinner mechanism 60, via an input port 102 that extends from a bottom surface 104 of the spinner mechanism 60, such that the bottom end 44 of the bottom straw 40 extends downwardly into the cup base 20 for immersion in the liquid. The input port 102 may be of tubular construction shaped to engage (e.g., frictionally, threadedly, or otherwise) the bottom straw 40. In this embodiment, the bottom straw 40 fits into and frictionally engages the input port 102. A simple frictional engagement contributes to quick and easy assembly and disassembly for cleaning and storage. While one embodiment of such engagement is shown herein, those skilled in the art may devise alternative engagement structures, and such alternatives should be considered within the scope of the present invention.

In this embodiment, the top straw 50 has a proximal end 52, a middle tubular body 54, and a distal end. The proximal end 52 of the top straw 50 may be engaged with the liquid outlet 120 of the spinner mechanism 60, in this case via a outlet port 122 that may be of generally tubular construction. In this embodiment, the top straw 50 extends through the straw aperture 32 of the top lid so that the distal end 56 extends from the drinking container 10. In this embodiment, the middle tubular body 54 includes a lid engagement structure 58 that engages the straw aperture 32 of the cup lid 30 so that the top straw 50 is fixed relative to the cup lid 30. In this embodiment, the lid engagement structure 58 allows air flow between the top straw 50 and the cup lid 30, to allow venting.

Figure 3:
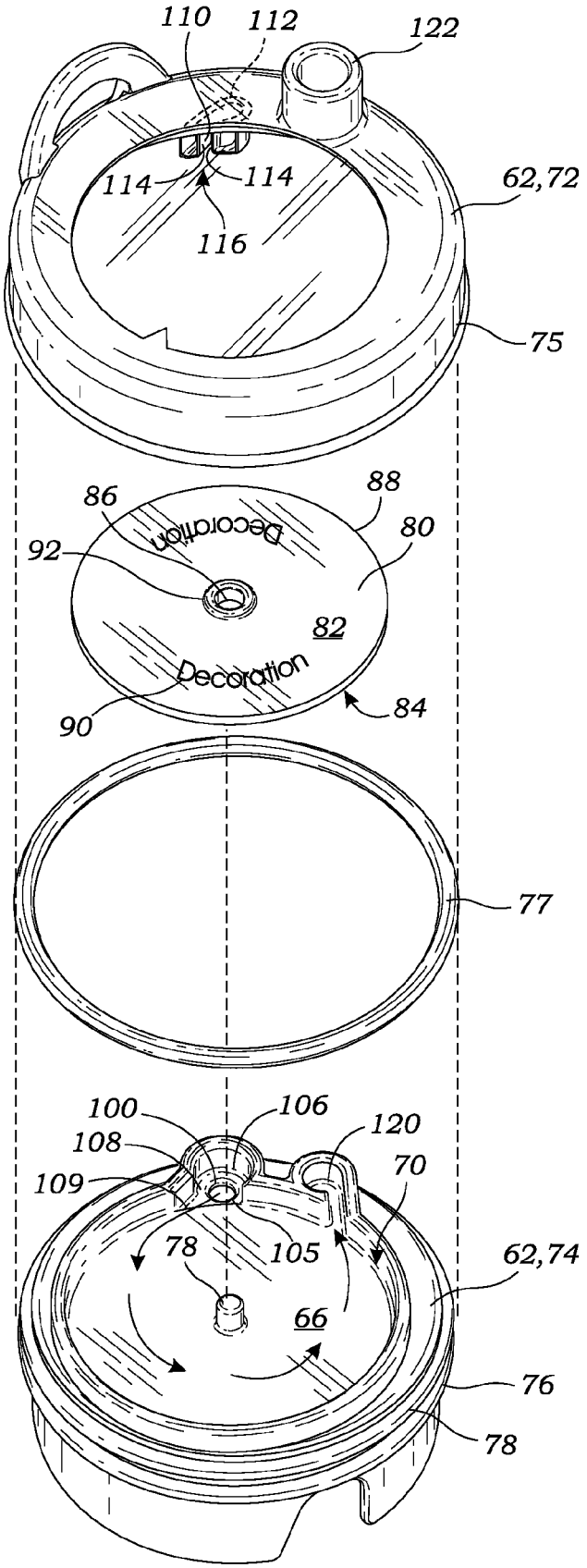
FIG. 3 is an exploded perspective view of a spinner mechanism of the drinking container of FIGS. 1 and 2.
Figure 4:
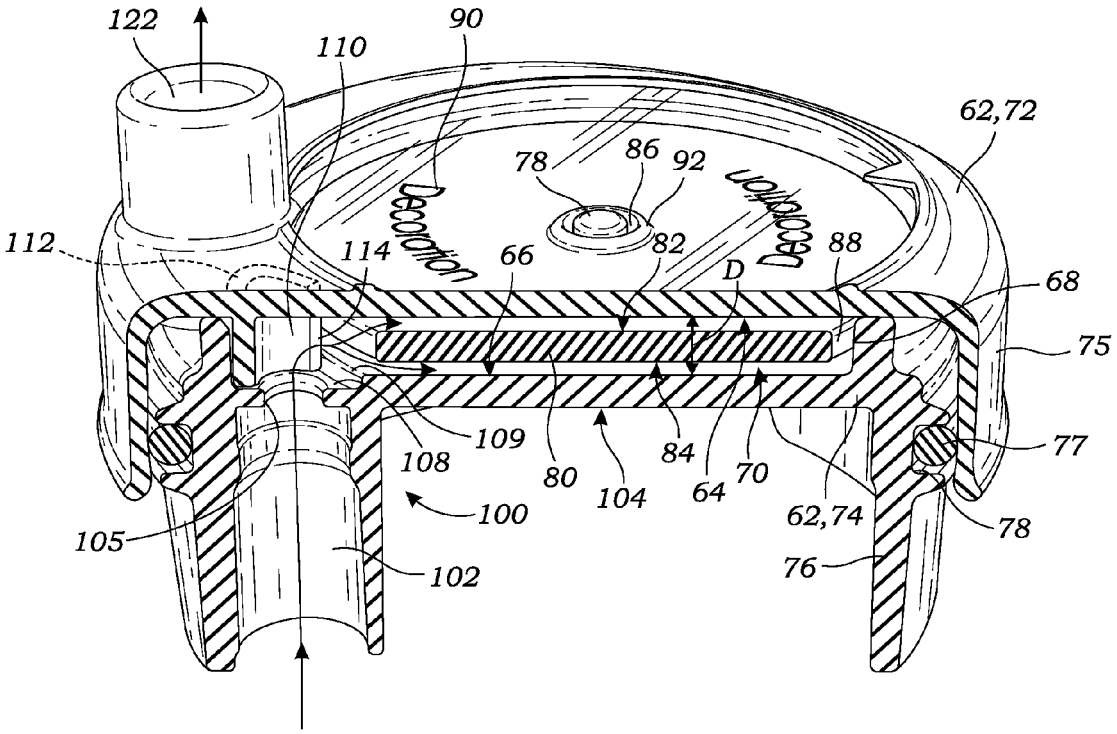
FIG. 4 is a perspective view of the spinner mechanism, with a portion of the spinner mechanism broken away to reveal the internal construction of the spinner mechanism.

FIG. 3 is an exploded perspective view of the spinner mechanism 60. FIG. 4 is a perspective view of the spinner mechanism 60, with a portion of the spinner mechanism 60 broken away to reveal the internal construction of the spinner mechanism 60. As shown in FIGS. 3 and 4, the spinner mechanism 60 includes a spinner housing 62 that forms a spinner chamber 70 that is shaped to receive a spinner disk 80. The spinner housing 62 is at least partially transparent so that the spinning of the spinner disk 80 may be observed by the person drinking from the drinking container 10.

As shown in FIGS. 3 and 4, the spinner housing 62 includes a first chamber surface 64 and a second chamber surface 66 that are spaced apart from each other a distance D by a chamber perimeter surface 68. The distance D may be consistent, or may vary, but should be sufficient to envelop the spinner disk 80 with the desired clearance, as discussed in greater detail below. The first and second chamber surfaces 64 and 66 and the chamber perimeter surface 68 together define the spinner chamber 70. In the present embodiment, the spinner housing 62 includes a first housing component 72 and a second housing component 74 that may be connected together to form the spinner housing 62. In this embodiment, the first housing component 72 includes the first chamber surface 64 and a first annular wall 75, and the second housing component 74 includes the second chamber surface 66 and a second annular wall 76. The first and second housing components 72 and 74 are pressed together around the spinner disk 80, and a connector 77 (e.g., a mechanical seal such as an O-ring, a threaded connection, or other form of connection known in the art). In the present embodiment, the first and second housing components 74 may be readily separated for cleaning; however, in some embodiments, they may be permanently connected. In this embodiment, the connector 77 is a mechanical seal such as an O-ring that is positioned between the first and second annular walls 75 and 76 (in a suitable groove, for example) for sealing and removably interlocking the first and second housing components 72 and 74, as shown.

An axle 78 extends upwardly from the second chamber surface 66 for rotatably mounting the spinner disk 80 in the spinner chamber 70. For purposes of this application, the term "axle" 78 is defined to include any form of structure that functions for rotatably mounting the spinner disk 80, and the term should be broadly construed to include alternative structures (e.g., a post, a pin, an annular wall, etc.). The terms "axle" and related terms (e.g., the center aperture, the hubs, etc.) are also expressly defined to include all inverse constructions, wherein the axle extends from the spinner disk 88 and engages a receiver (not shown) in the spinner chamber 70, or from the first chamber surface 64.

As shown in FIGS. 3 and 4, the spinner disk 80 has a top disk surface 82 and a bottom disk surface 84 that extend from a center aperture 86 to an outer disk perimeter 88. The top disk surface 82 may include decorative elements 90 that provide enjoyment and entertainment to the child (or other person) drinking from the drinking container 10. In this embodiment, the spinner disk 80 is shaped to fit securely within the spinner chamber 70 when the spinner disk 80 is mounted with the axle 78 through the center aperture 86 of the spinner disk 80. The clearance between the spinner housing 62 and the spinner disk 80 controls the velocity of the flow of the liquid, the pressure differential, as well as the volume that requires priming. This clearance should be optimized for the particular design to achieve high flow-velocity and a practical pressure differential for a given volumetric flow rate. Furthermore, the volume should be kept small to minimize the priming effort. In this embodiment, the spinner housing 62 envelops the spinner disk 80 with a nominal clearance of 0.01-0.1 inches between the first chamber surface 64 and the top disk surface 82, and between the second chamber surface 66 and the bottom disk surface 84.

In this embodiment, the top disk surface 82 and the bottom disk surface 84 of the spinner disk 80 are planar, and wherein the spinner disk 80 does not include paddles. For purposes of this application, the term "paddle" is hereby defined to include any form of paddle, vane, blade, or equivalent structure shaped to capture fluid flow. The absence of paddles enables the tight clearance between the spinner disk 80 and the spinner housing 62, which prevents undue air from mixing with the liquid, forming bubbles, and otherwise interfering with the person's drinking from the drinking container 10.

The spinner disk 80 may further include top and bottom spacers 92 and 94 extending outwardly from the top disk surface 82 and the bottom disk surface 84, respectively, which maintain a slip fit with the first and second chamber surfaces 64 and 66 to maintain space between the top and bottom disk surfaces 82 and 84 and the first and second chamber surfaces 64 and 66. The top and bottom spacers 92 and 94 may be in the form of annular hubs adjacent and around the center aperture 86.

As shown in FIGS. 3 and 4, the liquid input 100 may extend through the chamber perimeter surface 68 for directing the liquid at the spinner disk 80 for spinning the spinner disk 80. In this embodiment, the liquid input 100 is an input aperture 105 in an input chamber 106 formed in the chamber perimeter surface 68 of the spinner housing 62. The input chamber 106 has an input chamber floor 108 that is separated from the second chamber surface 64 by a step 109 so that the input chamber floor 108 is lower than the second chamber surface 66.

In this embodiment, the liquid input 100 further includes a jet nozzle 110 operably positioned adjacent the liquid input 100 for directing the liquid at the outer disk perimeter 88 so that jets of the liquid flow across the top and bottom disk surfaces 82 and 84 the spinner disk 80. The jets may be directed to follow a path that is generally circular around an axis of the spinner disk 80, to spin the spinner disk 80. In this embodiment, the jet nozzle 110 is a generally C-shaped wall extending downwardly from the first chamber surface 64 to fit within the input chamber 106, such that two ends 114 are positioned adjacent each other to form a restricted outlet 116. The restricted outlet 116 increases the velocity of the liquid when it enters the spinner chamber 70. While the C-shaped configuration is used in the present embodiment, the jet nozzle 110 may be any shape that produces a suitable jet of the liquid (e.g., round or slotted tube or orifice, nozzle, or other duct, etc.) when the liquid flows into the spinner housing 62 through the fluid input 100.

As shown in FIGS. 3 and 4, the spinner mechanism 60 further includes a liquid outlet 120 for allowing the liquid out of the spinner chamber 70 once it has contacted the spinner disk 80. The liquid outlet 120 may further include an outlet port 122 that engages (e.g., frictionally, threadedly, etc.) the top straw 50. In the present embodiment, both the top and bottom straws are constructed of a resilient material (e.g., plastic, rubber, elastomer, etc.) that can easily frictionally fit into or around a port or similar structure, for quick assembly and disassembly.

During use, the drinking container 10 is assembled, as shown in FIG. 1, and at least partially filled with the liquid that is to be consumed. When suction is applied to the top straw 50, the liquid is drawn up the bottom straw 40 by the pressure differential, through the jet nozzle 110, and sprayed into the spinner chamber 70 as described above. The liquid jets are directed across the spinner disk 80 as discussed above, such that the liquid jets flow across the top and bottom disk surfaces 82 and 84, around the axle 78 in a generally circular path, and then exit through the fluid outlet 120, and up the top straw 50.

The high speed fluid jet imparts viscous forces to the lower speed fluid surrounding it, acting to slow the fluid jet and speed the surrounding fluid. In accordance with the well-known "no slip" condition, adhesive forces between the fluid and the spinner disk 80 ensure that the fluid layer in direct contact with the spinner disk 80 has the same velocity as the spinner disk 80. So, the kinetic energy of the fluid jets is imparted to the spinner disk 80 through viscous and adhesive forces, promoting rotation of the spinner disk 80.

As the user drinks through the top straw 50, he or she can see the spinner disk 80 rotate (along with any decorative features 90 printed on or formed on the spinner disk 80), in an entertaining manner. The rate of spin varies depending upon the suction power applied by the user.

Figure 5:
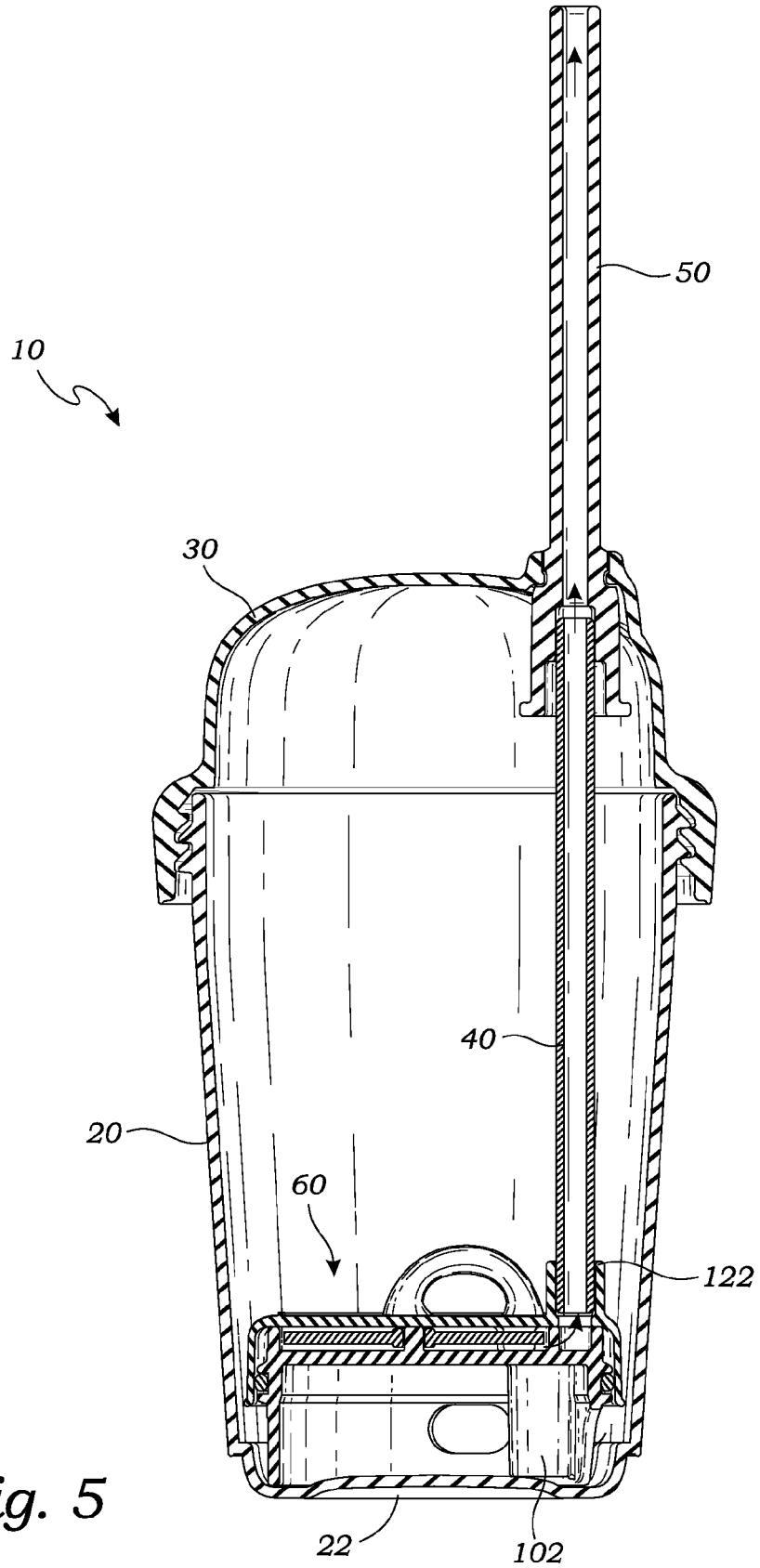
FIG. 5 is a side sectional view of a the drinking container illustrating another method of assembling the drinking container.

FIG. 5 is a side sectional view of the drinking container 10 illustrating another method of assembling the drinking container 10. In this arrangement, the spinner mechanism 60 is positioned elsewhere in or on the drinking container 10, in this case, in a bottom portion of the drinking container 10 adjacent the cup bottom 22. In this arrangement, the input port 102 is able to draw the liquid from the cup base 20, and the top and bottom straws 50 and 40 are connected together to extend from the outlet port 122 up to and through the cup lid 30. While this illustrates one embodiment of the present invention, alternative assemblies and constructions could also be used, according to the designs of one skilled in the art, and should be considered within the scope of the present invention.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A spinner mechanism for use by a person in drinking a liquid, the spinner mechanism comprising:

a spinner housing that includes a first chamber surface and a second chamber surface that are spaced apart from each other by a chamber perimeter surface, the first and second chamber surfaces and the chamber perimeter surface together defining a spinner chamber;

a spinner disk having a top disk surface and a bottom disk surface that extend to an outer disk perimeter, the spinner disk being shaped to be rotatably mounted within the spinner chamber;

a liquid input through the chamber perimeter surface for directing the liquid towards the outer disk perimeter such that the liquid flows across the top and bottom disk surfaces of the spinner disk to impart a spinning motion to the spinner disk when the liquid flows into and through the spinner chamber;

a liquid outlet for allowing the liquid out of the spinner chamber once it has contacted the spinner disk;

a top straw operably engaged with the liquid outlet so that the liquid may be sucked from the spinner housing for consumption by the person;

wherein the spinner housing envelops the spinner disk with a clearance and the clearance between the spinner housing and the spinner disk is optimized to achieve a high enough flow-velocity to spin the spinner disk from the volumetric flow rate expected from the person sucking on the top straw, and wherein the clearance is between 0.01-0.1 inches between the first chamber surface and the top disk surface, and also between the second chamber surface and the bottom disk surface;

wherein the liquid input is an input aperture in an input chamber formed in the chamber perimeter surface of the spinner housing, and further comprising a jet nozzle operably positioned adjacent the liquid input for directing the liquid at the outer disk perimeter so that the fluid flows across the top disk surface and the bottom disk surface of the spinner disk; and wherein the jet nozzle is shaped to produce a suitable jet of the liquid when the liquid flows into the spinner housing through the fluid input.

2. The spinner mechanism of claim 1, wherein the spinner housing includes a first housing component and a second housing component, wherein the first housing component includes the first chamber surface, and wherein the second housing component includes the second chamber surface.

3. The spinner mechanism of claim 1, wherein the jet nozzle is a generally C-shaped wall extending downwardly from the first chamber surface to fit within the input chamber, and wherein the C-shaped wall includes two ends that are positioned adjacent each other to form a restricted outlet.

4. The spinner mechanism of claim 3, wherein the input chamber has an input chamber floor that is separated from the second chamber surface by a step so that the input chamber floor is lower than the second chamber surface.

5. The spinner mechanism of claim 1, wherein the top disk surface and the bottom disk surface of the spinner disk are planar, and wherein the spinner disk does not include paddles.

6. The spinner mechanism of claim 1, wherein the spinner disk includes top and bottom spacers extending outwardly from the top disk surface and the bottom disk surface, respectively, which maintain a slip fit with the first and second chamber surfaces to maintain space between the top and bottom disk surfaces and the first and second chamber surfaces.

7. The spinner mechanism of claim 6, wherein the top and bottom spacers are in the form of annular hubs positioned adjacent and around the center aperture.

8. The spinner mechanism of claim 1, wherein the spinner housing includes a first housing component and a second housing component, wherein the first housing component includes the first chamber surface and a first annular wall, and wherein the second housing component includes the second chamber surface and a second annular wall; and further comprising a mechanical seal positioned between the first and second annular walls for sealing and removably interlocking the first and second housing components.

9. The spinner mechanism of claim 1, wherein the liquid input includes a bottom straw.

10. A spinner mechanism for use in a container adapted for drinking a liquid, the spinner mechanism comprising:

a spinner housing that includes a first chamber surface and a second chamber surface that are spaced apart from each other by a chamber perimeter surface, the first and second chamber surfaces and the chamber perimeter surface together defining a spinner chamber;

an axle extending upwardly from the second chamber surface;

a spinner disk having a top disk surface and a bottom disk surface that extend from a center aperture to an outer disk perimeter, the spinner disk being shaped to fit securely within the spinner chamber when the spinner disk is mounted with the axle through the center aperture of the spinner disk;

wherein the top disk surface and the bottom disk surface of the spinner disk are planar, and wherein the spinner disk does not include paddles;

top and bottom annular hubs extending outwardly from the top disk surface and the bottom disk surface, respectively, adjacent the center aperture, the top and bottom annular hubs in a slip fit with the first and second chamber surfaces, to maintain space between the top and bottom disk surfaces and the first and second chamber surfaces;

a liquid input through the chamber perimeter surface;

jet nozzle operably positioned adjacent the liquid input for directing the liquid at the outer disk perimeter so that the fluid flows towards the outer disk perimeter of the spinner disk and across the top disk surface and the bottom disk surface of the spinner disk, to impart a spinning motion to the spinning disk;

a liquid outlet for allowing the liquid out of the spinner chamber once it has contacted the spinner disk;

wherein the liquid input is an input aperture formed in the chamber perimeter surface of the spinner housing, and wherein the jet nozzle is a generally C-shaped wall extending downwardly from the first chamber surface to fit within the input chamber; and wherein the spinner housing envelops the spinner disk with a clearance and the clearance is between 0.01-0.1 inches between the first chamber surface and the top disk surface, and also between the second chamber surface and the bottom disk surface.

11. The spinner mechanism of claim 10, wherein the C-shaped wall includes two ends that are positioned adjacent each other to form a restricted outlet.

12. The spinner mechanism of claim 11, wherein the input chamber has an input chamber floor that is separated from the second chamber surface by a step so that the input chamber floor is lower than the second chamber surface.

* * * * *